US010937442B2

(12) United States Patent
Kawai et al.

(10) Patent No.: US 10,937,442 B2
(45) Date of Patent: Mar. 2, 2021

(54) SIGNAL PROCESSING DEVICE, TELECONFERENCING DEVICE, AND SIGNAL PROCESSING METHOD

(71) Applicant: YAMAHA CORPORATION, Hamamatsu (JP)

(72) Inventors: Tetsuto Kawai, Hamamatsu (JP); Kohei Kanamori, Hamamatsu (JP); Takayuki Inoue, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/701,771

(22) Filed: Dec. 3, 2019

(65) Prior Publication Data

US 2020/0105290 A1 Apr. 2, 2020

Related U.S. Application Data

(63) Continuation of application No. PCT/JP2017/021616, filed on Jun. 12, 2017.

(51) Int. Cl.

| | |
|---|---|
| ***G10L 21/0232*** | (2013.01) |
| ***G10L 21/0272*** | (2013.01) |
| ***G10L 21/0316*** | (2013.01) |
| ***H04R 1/40*** | (2006.01) |

(Continued)

(52) U.S. Cl.

CPC ..... *G10L 21/0232* (2013.01); *G10L 21/0272* (2013.01); *G10L 21/0316* (2013.01); *H04R 1/406* (2013.01); *H04R 3/005* (2013.01); *G10L 2021/02082* (2013.01)

(58) Field of Classification Search

None

See application file for complete search history.

(56) References Cited

U.S. PATENT DOCUMENTS

| | | | | |
|---|---|---|---|---|
| 6,738,482 | B1 * | 5/2004 | Jaber | H04R 1/406 379/406.01 |
| 8,462,962 | B2 | 6/2013 | Itou | |
| 9,426,566 | B2 | 8/2016 | Takahashi | |

(Continued)

FOREIGN PATENT DOCUMENTS

| | | | |
|---|---|---|---|
| JP | S63262577 | A | 10/1988 |
| JP | 2009049998 | A | 3/2009 |

(Continued)

OTHER PUBLICATIONS

English Language Translation of JP2015070291A, Takahashi. (Year: 2015).*

International Search Report issued in Intl. Appln. No. PCT/JP2017/021616 dated Aug. 1, 2017. English translation provided.

(Continued)

*Primary Examiner* — Paul W Huber

(74) *Attorney, Agent, or Firm* — Rossi, Kimms & McDowell LLP

(57) ABSTRACT

A signal processing method performs echo reduction processing on at least one of a collected sound signal of a first microphone, a collected sound signal of a second microphone, or both the collected sound signal of the first microphone and the collected sound signal of the second microphone, and calculates a correlated component between the collected sound signal of the first microphone and the collected sound signal of the second microphone, using a collected sound signal of which echo has been reduced by the an echo reduction processing.

20 Claims, 8 Drawing Sheets

(51) Int. Cl.
*H04R 3/00* (2006.01)
*G10L 21/0208* (2013.01)

(56) References Cited

U.S. PATENT DOCUMENTS

| | | | | |
|---|---|---|---|---|
| 9,510,095 | B2 | 11/2016 | Takahashi | |
| 2009/0067642 | A1 | 3/2009 | Buck | |
| 2014/0328490 | A1* | 11/2014 | Mohammad | H04R 3/002 381/66 |
| 2014/0376742 | A1* | 12/2014 | Hetherington | H04R 29/004 381/94.2 |
| 2015/0181329 | A1 | 6/2015 | Mikami | |

FOREIGN PATENT DOCUMENTS

| | | | |
|---|---|---|---|
| JP | 2013061421 | A | 4/2013 |
| JP | 2014229932 | A | 12/2014 |
| JP | 2015070291 | A | 4/2015 |
| WO | 2009104252 | A1 | 8/2009 |
| WO | 2014024248 | A1 | 2/2014 |
| WO | 2015049921 | A1 | 4/2015 |

OTHER PUBLICATIONS

Written Opinion issued in Intl. Appln. No. PCT/JP2017/021616 dated Aug. 1, 2017.

Extended European Search Report issued European Appln. No. 17913502.5 dated Dec. 16, 2020.

Office Action issued in Japanese Appln. No. 2019-524558 dated Dec. 22, 2020. English machine translation provided.

* cited by examiner

SIGNAL PROCESSING DEVICE, TELECONFERENCING DEVICE, AND SIGNAL PROCESSING METHOD

CROSS REFERENCE TO RELATED APPLICATIONS

The present application is a continuation of International Application No. PCT/JP2017/021616, filed on Jun. 12, 2017, the entire contents of which are incorporated herein by reference.

BACKGROUND

1. Field

A preferred embodiment of the present invention relates to a signal processing device, a teleconferencing device, and a signal processing method that obtain sound of a sound source by using a microphone.

2. Description of the Related Art

Japanese Unexamined Patent Application Publication No. 2009-049998 and International publication No. 2014/024248 disclose a configuration to enhance a target sound by the spectrum subtraction method. The configuration of Japanese Unexamined Patent Application Publication No. 2009-049998 and International publication No. 2014/024248 extracts a correlated component of two microphone signals as a target sound. In addition, each configuration of Japanese Unexamined Patent Application Publication No. 2009-049998 and International publication No. 2014/024248 is a technique of performing noise estimation in filter processing by an adaptive algorithm and performing processing of enhancing the target sound by the spectral subtraction method.

SUMMARY

A signal processing method performs echo reduction processing on at least one of a collected sound signal of a first microphone, a collected sound signal of a second microphone, or both the collected sound signal of the first microphone and the collected sound signal of the second microphone, and calculates a correlated component between the collected sound signal of the first microphone and the collected sound signal of the second microphone, using a collected sound signal of which echo has been reduced by the an echo reduction processing.

DETAILED DESCRIPTION OF THE PREFERRED EMBODIMENTS

As in the conventional art, in a case of a device that obtains sound of a sound source, using a microphone, the sound outputted from a speaker may be diffracted as an echo component. Since the echo component is inputted as the same component to two microphone signals, the correlation is very high. Therefore, the echo component becomes a target sound and the echo component may be enhanced.

In view of the foregoing, an object of a preferred embodiment of the present invention is to provide a signal processing device, a teleconferencing device, and a signal processing method that are able to calculate a correlated component, with higher accuracy than conventionally.

Figure 1:
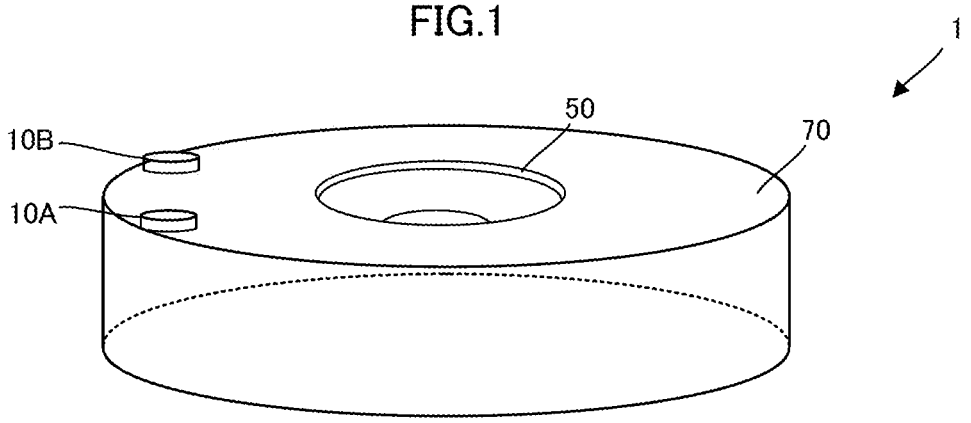
FIG. 1 is a schematic view showing a configuration of a signal processing device 1.

FIG. 1 is an external schematic view showing a configuration of a signal processing device 1. In FIG. 1, the main configuration according to sound collection and sound emission is described and other configurations are not described. The signal processing device 1 includes a housing 70 with a cylindrical shape, a microphone 10A, a microphone 10B, and a speaker 50. The signal processing device 1 according to a preferred embodiment of the present invention, as an example, collects sound. The signal processing device 1 outputs a collected sound signal according to the sound that has been collected, to another device. The signal processing device 1 receives an emitted sound signal from another device and outputs the sound signal from a speaker. Accordingly, the signal processing device 1 is able to be used as a teleconferencing device.

The microphone 10A and the microphone 10B are disposed at an outer peripheral position of the housing 70 on an upper surface of the housing 70. The speaker 50 is disposed on the upper surface of the housing 70 so that sound may be emitted toward the upper surface of the housing 70. However, the shape of the housing 70, the placement of the microphones, and the placement of the speaker are merely examples and are not limited to these examples.

Figure 2:
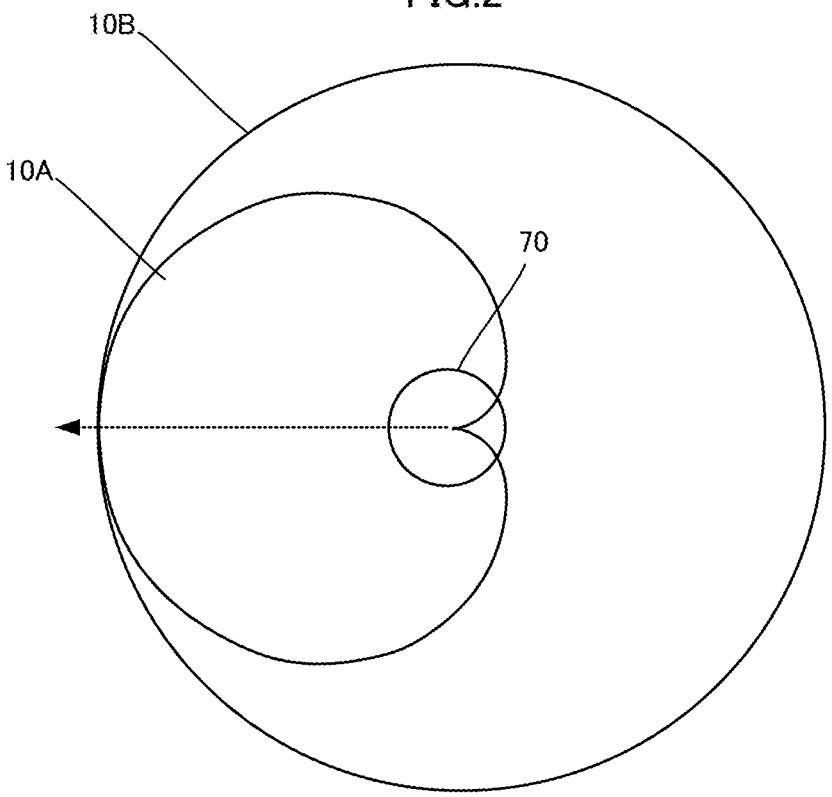
FIG. 2 is a plan view showing directivity of a microphone 10A and a microphone 10B.

FIG. 2 is a plan view showing directivity of the microphone 10A and the microphone 10B. As shown in FIG. 2, the microphone 10A is a directional microphone having the highest sensitivity in front (the left direction in the figure) of the device and having no sensitivity in back (the right direction in the figure) of the device. The microphone 10B is a non-directional microphone having uniform sensitivity in all directions. However, the directivity of the microphone 10A and the microphone 10B shown in FIG. 2 is an example. For example, both the microphone 10A and the microphone 10B may be non-directional microphones.

Figure 3:
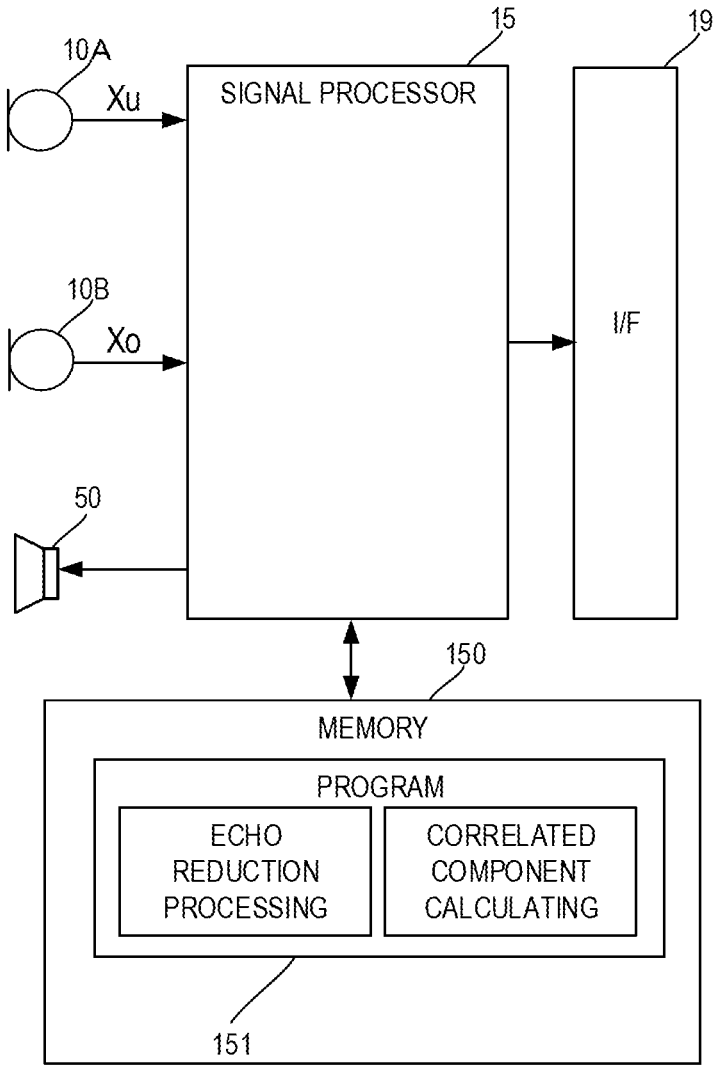
FIG. 3 is a block diagram showing a configuration of the signal processing device 1.

FIG. 3 is a block diagram showing a configuration of the signal processing device 1. The signal processing device 1 includes the microphone 10A, the microphone 10B, the speaker 50, a signal processor 15, a memory 150, and an interface (I/F) 19.

The signal processor 15 includes a CPU or a DSP. The signal processor 15 performs signal processing by reading out a program 151 stored in the memory 150 being a storage medium and executing the program. For example, the signal processor 15 controls the level of a collected sound signal Xu of the microphone 10A or a collected sound signal Xo of the microphone 10B, and outputs the signal to the I/F 19. It is to be noted that, in the present preferred embodiment, the description of an A/D converter and a D/A converter is omitted, and all various types of signals are digital signals unless otherwise described.

The I/F 19 transmits a signal inputted from the signal processor 15, to other devices. In addition, the I/F 19 receives an emitted sound signal from other devices and inputs the signal to the signal processor 15. The signal processor 15 performs processing such as level adjustment of the emitted sound signal inputted from other devices, and causes sound to be outputted from the speaker 50.

Figure 4:
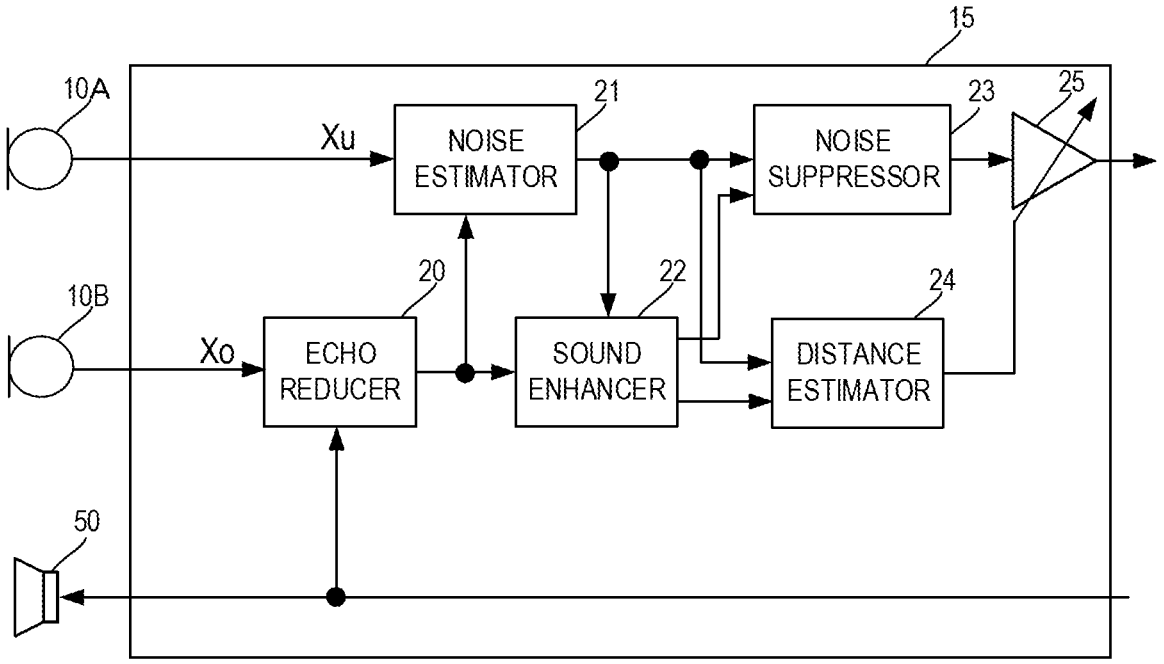
FIG. 4 is a block diagram showing an example of a configuration of a signal processor 15.
Figure 5:
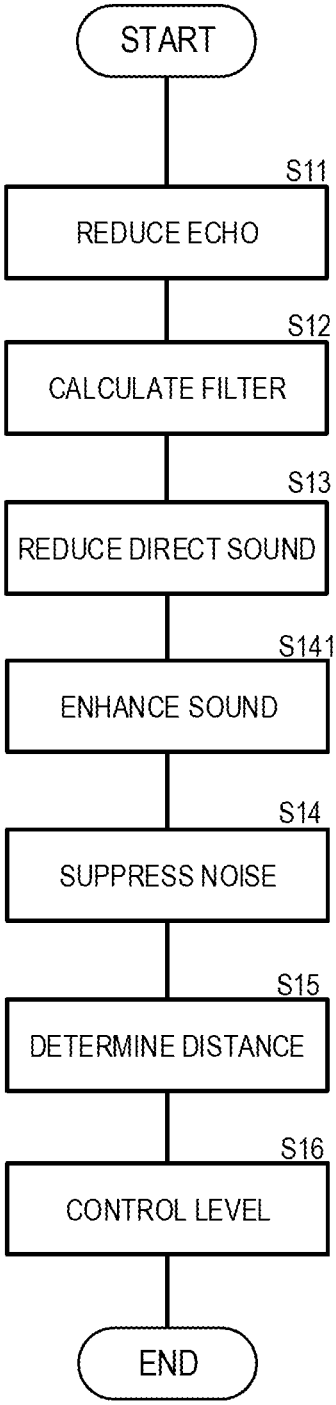
FIG. 5 is a flow chart showing an operation of the signal processor 15.

FIG. 4 is a block diagram showing a functional configuration of the signal processor 15. The signal processor 15 executes the program to achieve the configuration shown in FIG. 4. The signal processor 15 includes an echo reducer 20, a noise estimator 21, a sound enhancer 22, a noise suppressor 23, a distance estimator 24, and a gain adjuster 25. FIG. 5 is a flow chart showing an operation of the signal processor 15.

The echo reducer 20 receives a collected sound signal Xo of the microphone 10B, and reduces an echo component from an inputted collected sound signal Xo (S11). It is to be noted that the echo reducer 20 may reduce an echo component from the collected sound signal Xu of the microphone 10A or may reduce an echo component from both the collected sound signal Xu of the microphone 10A and the collected sound signal Xo of the microphone 10B.

The echo reducer 20 receives a signal (an emitted sound signal) to be outputted to the speaker 50. The echo reducer 20 performs echo reduction processing with an adaptive filter. In other words, the echo reducer 20 estimates a feedback component to be obtained when an emitted sound signal is outputted from the speaker 50 and reaches the microphone 10B through a sound space. The echo reducer 20 estimates a feedback component by processing an emitted sound signal with an FIR filter that simulates an impulse response in the sound space. The echo reducer 20 reduces an estimated feedback component from the collected sound signal Xo. The echo reducer 20 updates a filter coefficient of the FIR filter using an adaptive algorithm such as LMS or RLS.

The noise estimator 21 receives the collected sound signal Xu of the microphone 10A and an output signal of the echo reducer 20. The noise estimator 21 estimates a noise component, based on the collected sound signal Xu of the microphone 10A and the output signal of the echo reducer 20.

Figure 6:
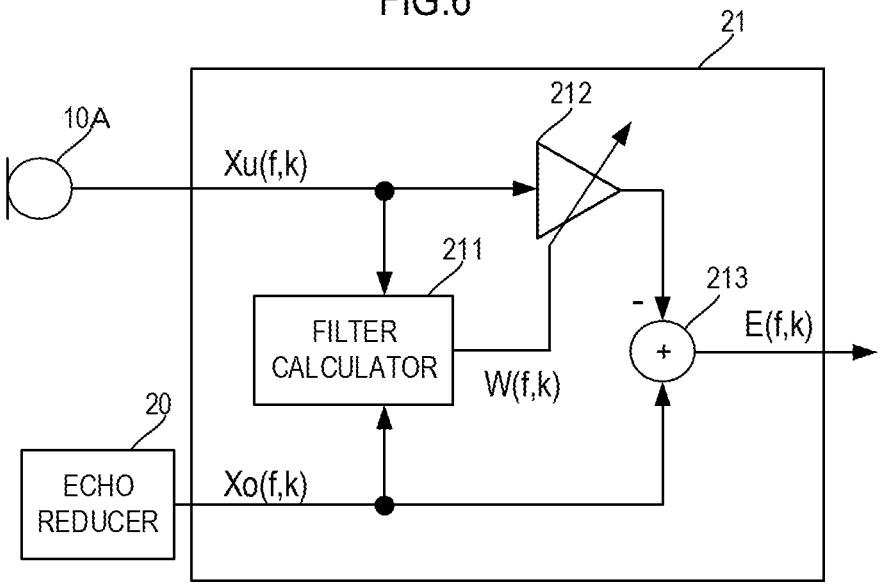
FIG. 6 is a block diagram showing a functional configuration of a noise estimator 21.

FIG. 6 is a block diagram showing a functional configuration of the noise estimator 21. The noise estimator 21 includes a filter calculator 211, a gain adjuster 212, and an adder 213. The filter calculator 211 calculates a gain W(f, k) for each frequency in the gain adjuster 212 (S12).

It is to be noted that the noise estimator 21 applies the Fourier transform to each of the collected sound signal Xo and the collected sound signal Xu, and converts the signals into a signal Xo(f, k) and a signal Xu(f, k) of a frequency axis. The "f" represents a frequency and the "k" represents a frame number.

The gain adjuster 212 extracts a target sound by multiplying the collected sound signal Xu(f, k) by the gain W(f, k) for each frequency. The filter calculator 211 updates the gain of the gain adjuster 212 in update processing by the adaptive algorithm. However, the target sound to be extracted by processing of the gain adjuster 212 and the filter calculator 211 is only a correlated component of direct sound from a sound source to the microphone 10A and the microphone 10B. The impulse response corresponding to a component of indirect sound is ignored. Therefore, the filter calculator 211, in the update processing by the adaptive algorithm such as NLMS or RLS, performs update processing with only several frames being taken into consideration.

Then, the noise estimator 21, in the adder 213, as shown in the following equations, reduces the component of the direct sound, from the collected sound signal Xo(f, k), by subtracting the output signal W(f, k)·Xu(f, k) of the gain adjuster 212 from the collected sound signal Xo(f, k) (S13).

$$E(f,k)=X_o(f,k)-W(f,k)X_u(f,k) \quad \text{[Equation 1]}$$

Accordingly, the noise estimator 21 is able to estimate a noise component E(f, k) which reduced the correlated component of the direct sound from the collected sound signal Xo (f, k).

Subsequently, the signal processor 15, in the noise suppressor 23, performs noise suppression processing by the spectral subtraction method, using the noise component E(f, k) estimated by the noise estimator 21 (S14).

Figure 7:
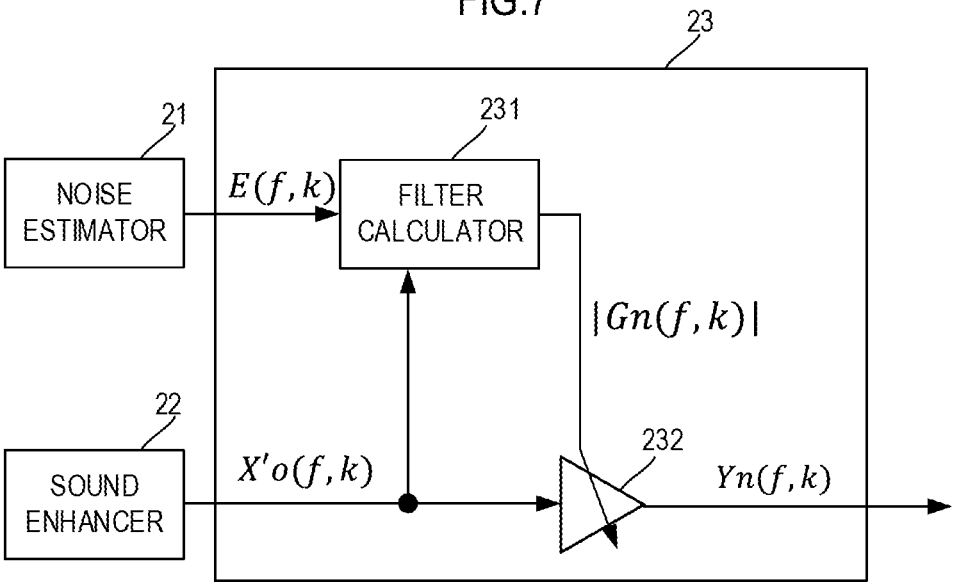
FIG. 7 is a block diagram showing a functional configuration of a noise suppressor 23.

FIG. 7 is a block diagram showing a functional configuration of the noise suppressor 23. The noise suppressor 23 includes a filter calculator 231 and a gain adjuster 232. The noise suppressor 23 performs noise suppression processing by the spectral subtraction method. In other words, the noise suppressor 23, as shown in the following equation 2, calculates spectral gain |Gn(f, k)|, using the noise component E(f, k) estimated by the noise estimator 21.

$$|G_n(f,k)| = \frac{\max(|X'_o(f,k)| - \beta(f,k)|E(f,k)|, 0)}{|X'_o(f,k)|} \quad \text{[Equation 2]}$$

Herein, β(f, k) is a coefficient to be multiplied by a noise component, and has a different value for each time and frequency. The β(f, k) is properly set according to the use environment of the signal processing device 1. For example, the β value is able to be set to be increased for the frequency of which the level of a noise component is increased.

In addition, in this present preferred embodiment, a signal to be subtracted by the spectral subtraction method is an output signal X'o(f, k) of the sound enhancer 22. The sound enhancer 22, before the noise suppression processing by the noise suppressor 23, as shown in the following equation 3, calculates an average of the signal Xo(f, k) of which the echo has been reduced and the output signal W(f, k)·Xu(f, k) of the gain adjuster 212 (S141).

$$X'_o(f,k)=0.5\times\{X_o(f,k)+W(f,k)X_u(f,k)\} \quad \text{[Equation 3]}$$

The output signal W(f, k)·Xu(f, k) of the gain adjuster 212 is a component correlated with the Xo(f, k) and is equivalent to a target sound. Therefore, the sound enhancer 22, by calculating the average of the signal Xo(f, k) of which the echo has been reduced and the output signal W(f, k)·Xu(f, k) of the gain adjuster 212, enhances sound that is a target sound.

The gain adjuster 232 calculates an output signal Yn(f, k) by multiplying the spectral gain|Gn(f, k)| calculated by the filter calculator 231 by the output signal X'o(f, k) of the sound enhancer 22.

It is to be noted that the filter calculator 231 may further calculate spectral gain G'n(f, k) that causes a harmonic component to be enhanced, as shown in the following equation 4.

$$|G'_n(f,k)| = \max\{|G_{n1}(f,k)|, |G_{n2}(f,k)|, \ldots, |G_{nl}(f,k)|\} \quad \text{[Equation 4]}$$

$$|G_w(f,k)| = \left|Gn\left(\frac{f}{i}, k\right)\right|$$

Here, i is an integer. According to the equation 4, the integral multiple component (that is, a harmonic component) of each frequency component is enhanced. However, when the value of f/i is a decimal, interpolation processing is performed as shown in the following equation 5.

$$|G_{ni}(f,k)| = \frac{m}{i}\left\{\left|Gn\left(floor\left(\frac{f}{i}\right), k\right)\right| + \left|Gn\left(ceil\left(\frac{f}{i}\right), k\right)\right|\right\} \quad \text{[Equation 5]}$$

Subtraction processing of a noise component by the spectral subtraction method subtracts a larger number of high frequency components, so that sound quality may be degraded. However, in the present preferred embodiment, since the harmonic component is enhanced by the spectral gain G'n(f, k), degradation of sound quality is able to be prevented.

As shown in FIG. 4, the gain adjuster 25 receives the output signal Yn(f, k) of which the noise component has been suppressed by sound enhancement, and performs a gain adjustment. The distance estimator 24 determines a gain Gf(k) of the gain adjuster 25.

Figure 8:
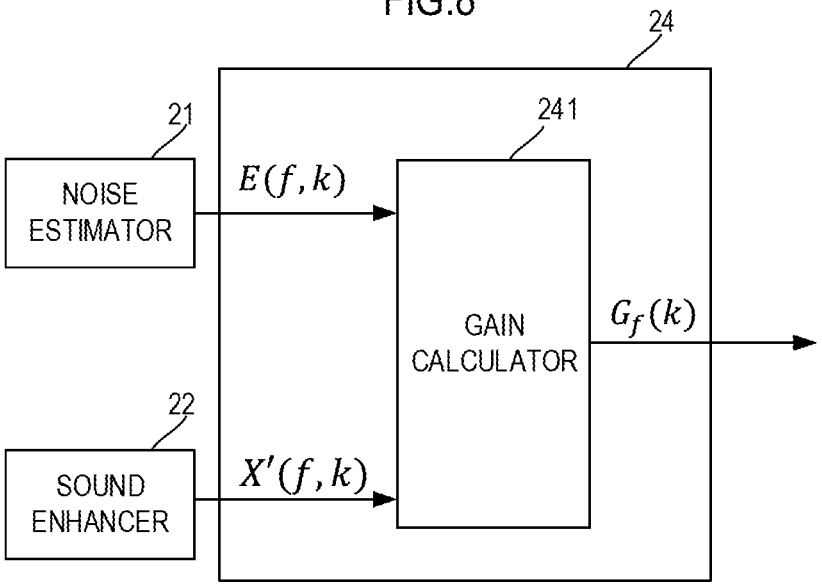
FIG. 8 is a block diagram showing a functional configuration of a distance estimator 24.

FIG. 8 is a block diagram showing a functional configuration of the distance estimator 24. The distance estimator 24 includes a gain calculator 241. The gain calculator 241 receives an output signal E(f, k) of the noise estimator 21, and an output signal X'(f, k) of the sound enhancer 22, and estimates the distance between a microphone and a sound source (S15).

The gain calculator 241 performs noise suppression processing by the spectral subtraction method, as shown in the following equation 6. However, the multiplication coefficient γ of a noise component is a fixed value and is a value different from a coefficient β(f, k) in the noise suppressor 23.

$$|G_s(f,k)| = \frac{\max(|X'_o(f,k)| - \gamma|E(f,k)|, 0)}{|X'_o(f,k)|} \quad \text{[Equation 6]}$$

$$G_{th}(k) = \frac{1}{M + 1_{bin}} \sum_{n=0}^{M_{bin}} |G_s(n,k)|$$

$$G_f(k) = \begin{cases} a & (G_{th}(k) > \text{threshold}) \\ b & \text{otherwise} \end{cases}$$

The gain calculator 241 further calculates an average value Gth(k) of the level of all the frequency components of the signal that has been subjected to the noise suppression processing. Mbin is the upper limit of the frequency. The average value Gth(k) is equivalent to a ratio between a target sound and noise. The ratio between a target sound and noise is reduced as the distance between a microphone and a sound source is increased and is increased as the distance between a microphone and a sound source is reduced. In other words, the average value Gth(k) corresponds to the distance between a microphone and a sound source. Accordingly, the gain calculator 241 functions as a distance estimator that estimates the distance of a sound source based on the ratio between a target sound (the signal that has been subjected to the sound enhancement processing) and a noise component.

The gain calculator 241 changes the gain Gf(k) of the gain adjuster 25 according to the value of the average value Gth(k) (S16). For example, as shown in the equation 6, in a case in which the average value Gth(k) exceeds a threshold value, the gain Gf(k) is set to the specified value a, and, in a case in which the average value Gth(k) is not larger than the threshold value, the gain Gf(k) is set to the specified value b (b<a). Accordingly, the signal processing device 1 does not collect sound from a sound source far from the device, and is able to enhance sound from a sound source close to the device as a target sound.

It is to be noted that, in the present preferred embodiment, the sound of the collected sound signal Xo of the non-directional microphone 10B is enhanced, subjected to gain adjustment, and outputted to the I/F 19. However, the sound of the collected sound signal Xu of the directional microphone 10A may be enhanced, subjected to gain adjustment, and outputted to the I/F 19. However, the microphone 10B is a non-directional microphone and is able to collect sound of the whole surroundings. Therefore, it is preferable to adjust the gain of the collected sound signal Xo of the microphone 10B and to output the adjusted sound signal to the I/F 19.

The technical idea described in the present preferred embodiment will be summarized as follows.

1. A signal processing device includes a first microphone (a microphone 10A), a second microphone (a microphone 10B), and a signal processor 15. The signal processor 15 (an echo reducer 20) performs echo reduction processing on at least one of a collected sound signal Xu of the microphone 10A, or a collected sound signal Xo of the microphone 10B. The signal processor 15 (a noise estimator 21) calculates an output signal W(f, k)·Xu(f, k) being a correlated component between the collected sound signal of the first microphone and the collected sound signal of the second microphone, using a signal Xo(f, k) of which echo has been reduced by the echo reduction processing.

As with Japanese Unexamined Patent Application Publication No. 2009-049998 and International publication No. 2014/024248, in a case in which echo is generated when a correlated component is calculated using two signals, the echo component is calculated as a correlated component, which causes the echo component to be enhanced as a target sound. However, the signal processing device according to the present preferred embodiment, since calculating a correlated component using a signal of which the echo has been reduced, is able to calculate a correlated component, with higher accuracy than conventionally.

2. The signal processor 15 calculates an output signal W(f, k)·Xu(f, k) being a correlated component by performing filter processing by an adaptive algorithm, using a current input signal or the current input signal and several previous input signals.

For example, Japanese Unexamined Patent Application Publication No. 2009-049998 and International publication No. 2014/024248 employ the adaptive algorithm in order to estimate a noise component. In an adaptive filter using the adaptive algorithm, a calculation load becomes excessive as the number of taps is increased. In addition, since a reverberation component of sound is included in processing using the adaptive filter, it is difficult to estimate a noise component with high accuracy.

On the other hand, in the present preferred embodiment, the output signal W(f, k)·Xu(f, k) of the gain adjuster 212, as a correlated component of direct sound, is calculated by the filter calculator 211 in the update processing by the adaptive algorithm. As described above, the update processing is update processing in which an impulse response that is equivalent to a component of indirect sound is ignored and only one frame (a current input value) is taken into consideration. Therefore, the signal processor 15 of the present preferred embodiment is able to remarkably reduce the calculation load in the processing to estimate a noise component E(f, k). In addition, the update processing of the adaptive algorithm is the processing in which an indirect sound component is ignored. In the update processing of the adaptive algorithm, the reverberation component of sound has no effect, so that a correlated component is able to be estimated with high accuracy. However, the update processing is not limited only to one frame (the current input value). The filter calculator 211 may perform update processing including several past signals.

3. The signal processor 15 (the sound enhancer 22) performs sound enhancement processing using a correlated component. The correlated component is the output signal W(f, k)·Xu(f, k) of the gain adjuster 212 in the noise estimator 21. The sound enhancer 22, by calculating an average of the signal Xo(f, k) of which the echo has been reduced and the output signal W(f, k)·Xu(f, k) of the gain adjuster 212, enhances sound that is a target sound.

In such a case, since the sound enhancement processing is performed using the correlated component calculated by the noise estimator 21, sound is able to be enhanced with high accuracy.

4. The signal processor 15 (the noise suppressor 23) uses a correlated component and performs processing of reducing the correlated component.

5. More specifically, the noise suppressor 23 performs processing of reducing a noise component using the spectral subtraction method. The noise suppressor 23 uses the signal of which the correlated component has been reduced by the noise estimator 21, as a noise component.

The noise suppressor 23, since using a highly accurate noise component E(f, k) calculated in the noise estimator 21, as a noise component in the spectral subtraction method, is able to suppress a noise component, with higher accuracy than conventionally.

6. The noise suppressor 23 further performs processing of enhancing a harmonic component in the spectral subtraction method. Accordingly, since the harmonic component is enhanced, the degradation of the sound quality is able to be prevented.

7. The noise suppressor 23 sets a different gain β(f, k) for each frequency or for each time in the spectral subtraction method. Accordingly, a coefficient to be multiplied by a noise component is set to a suitable value according to environment.

8. The signal processor 15 includes a distance estimator 24 that estimates a distance of a sound source. The signal processor 15, in the gain adjuster 25, adjusts a gain of the collected sound signal of the first microphone or the collected sound signal of the second microphone, according to the distance that the distance estimator 24 has estimated. Accordingly, the signal processing device 1 does not collect sound from a sound source far from the device, and is able to enhance sound from a sound source close to the device as a target sound.

9. The distance estimator 24 estimates the distance of the sound source, based on a ratio of a signal X'(f, k) on which sound enhancement processing has been performed using the correlated component and a noise component E(f, k) extracted by the processing of reducing the correlated component. Accordingly, the distance estimator 24 is able to estimate a distance with high accuracy.

Finally, the foregoing preferred embodiments are illustrative in all points and should not be construed to limit the present invention. The scope of the present invention is defined not by the foregoing preferred embodiment but by the following claims. Further, the scope of the present invention is intended to include all modifications within the scopes of the claims and within the meanings and scopes of equivalents.

What is claimed is:

1. A signal processing device comprising:

a first microphone;

a second microphone;

at least one memory device that stores instructions; and at least one processor that executes the instructions, wherein the instructions, when executed, cause the at least one processor to:

perform echo reduction processing on a collected sound signal of the first microphone, a collected sound signal of the second microphone, or both the collected sound signal of the first microphone and the collected sound signal of the second microphone; and calculate a correlated component between the collected sound signal of the first microphone and the collected sound signal of the second microphone, using a collected sound signal of which an echo has been reduced by the echo reduction processing, wherein the instructions cause the at least one processor to calculate the correlated component by performing filter processing by an adaptive algorithm, using a current input signal or the current input signal and several previous input signals, and wherein the current input signal and the several previous input signals correspond to a component of direct sound.

2. A signal processing device comprising:

a first microphone;

a second microphone; and a digital signal processor configured to perform echo reduction processing on a collected sound signal of the first microphone, a collected sound signal of the second microphone, or both the collected sound signal of the first microphone and the collected sound signal of the second microphone, and to calculate a correlated component between the collected sound signal of the first microphone and the collected sound signal of the second microphone, using a collected sound signal of which an echo has been reduced by the echo reduction processing, wherein the digital signal processor is configured to calculate the correlated component by performing filter processing by an adaptive algorithm, using a current input signal or the current input signal and several previous input signals, and wherein the current input signal and the several previous input signals correspond to a component of direct sound.

3. The signal processing device according to claim 2, wherein the digital signal processor is configured to perform sound enhancement processing, using the correlated component.

4. The signal processing device according to claim 2, wherein the digital signal processor is configured to perform reduction processing of the correlated component, using the correlated component.

5. The signal processing device according to claim 4, wherein the digital signal processor is configured to perform reduction processing of a noise component, using a spectral subtraction method; and a signal on which the reduction processing of the correlated component has been performed is used as the noise component.

6. The signal processing device according to claim 5, wherein the digital signal processor is configured to perform processing of enhancing a harmonic component in the spectral subtraction method.

7. The signal processing device according to claim 5, wherein the digital signal processor is configured to set a different gain for each frequency or for each time in the spectral subtraction method.

8. The signal processing device according to claim 2, further comprising a distance estimator that estimates a distance of a sound source, wherein the digital signal processor is configured to adjust a gain of the collected sound signal of the first microphone or the collected sound signal of the second microphone, according to the distance that the distance estimator has estimated.

9. The signal processing device according to claim 8, wherein the distance estimator estimates the distance of the sound source, based on a ratio of a signal on which sound enhancement processing has been performed using the correlated component and a noise component extracted by the reduction processing of the correlated component.

10. The signal processing device according to claim 2, wherein the first microphone is a directional microphone; and the second microphone is a non-directional microphone.

11. The signal processing device according to claim 2, wherein the signal digital processor is configured to perform the echo reduction processing on the collected sound signal of the second microphone.

12. A teleconferencing device comprising:

the signal processing device according to claim 2; and a speaker.

13. A signal processing method comprising:

performing echo reduction processing on a collected sound signal of a first microphone, a collected sound signal of a second microphone, or both the collected sound signal of the first microphone and the collected sound signal of the second microphone;

calculating a correlated component between the collected sound signal of the first microphone and the collected sound signal of the second microphone, using a collected sound signal of which an echo has been reduced by the echo reduction processing; and calculating the correlated component by performing filter processing by an adaptive algorithm, using a current input signal, or the current input signal and several previous input signals, wherein the current input signal and the several previous input signals correspond to a component of direct sound.

14. The signal processing method according to claim 13, further comprising performing sound enhancement processing, using the correlated component.

15. The signal processing method according to claim 13, further comprising performing reduction processing of the correlated component using the correlated component.

16. The signal processing method according to claim 15, further comprising:

performing reduction processing of a noise component, using a spectral subtraction method; and using a signal on which the reduction processing of the correlated component has been performed, as the noise component.

17. The signal processing method according to claim 16, further comprising performing processing of enhancing a harmonic component in the spectral subtraction method.

18. The signal processing method according to claim 16, further comprising setting a different gain for each frequency or for each time in the spectral subtraction method.

19. The signal processing method according to claim 13, further comprising:

estimating a distance of a sound source; and adjusting a gain of the collected sound signal of the first microphone or the collected sound signal of the second microphone, according to the distance that the distance estimator has estimated.

20. The signal processing method according to claim 19, further comprising estimating the distance of the sound source, based on a ratio of a signal on which sound enhancement processing has been performed using the correlated component and a noise component extracted by the reduction processing of the correlated component.

* * * * *